US009559479B2

(12) United States Patent
Logvinov et al.

(10) Patent No.: US 9,559,479 B2
(45) Date of Patent: Jan. 31, 2017

(54) ANGLED CONNECTOR FOR CONNECTING TWO DEVICES AND HAVING A FASTENING DEVICE

(71) Applicants: STMicroelectronics, Inc., Coppell, TX (US); Tatung Company, Taipei (TW)

(72) Inventors: Oleg Logvinov, East Brunswick, NJ (US); Tai-Jee Pan, Beaverton, OR (US)

(73) Assignees: STMICROELECTRONICS, INC., Coppell, TX (US); TATUNG COMPANY, Taipei (TW)

( * ) Notice: Subject to any disclaimer, the term of this patent is extended or adjusted under 35 U.S.C. 154(b) by 0 days.

(21) Appl. No.: 14/513,988

(22) Filed: Oct. 14, 2014

(65) Prior Publication Data

US 2015/0104966 A1 Apr. 16, 2015

Related U.S. Application Data

(60) Provisional application No. 61/889,964, filed on Oct. 11, 2013.

(51) Int. Cl.

| | |
|---|---|
| ***H01R 13/60*** | (2006.01) |
| ***H01R 13/66*** | (2006.01) |
| ***H01R 43/26*** | (2006.01) |
| ***H01R 13/621*** | (2006.01) |
| ***H01R 12/50*** | (2011.01) |
| ***H01R 31/06*** | (2006.01) |

(52) U.S. Cl.

CPC ..... *H01R 43/26* (2013.01); *H01R 13/621* (2013.01); *H01R 23/7073* (2013.01); *H01R 31/06* (2013.01); *Y10T 29/49174* (2015.01)

(58) Field of Classification Search

CPC ... H01R 13/62; H01R 13/621; H01R 13/6275; H01R 13/639; H01R 23/7073; H01R 25/00; H01R 43/26; H01R 13/60; H01R 23/2073

USPC ..... 439/541.5, 345, 352, 638

See application file for complete search history.

(56) References Cited

U.S. PATENT DOCUMENTS

| | | | | |
|---|---|---|---|---|
| 6,183,292 | B1 * | 2/2001 | Chen | H01R 23/6873 439/541.5 |
| 6,213,782 | B1 * | 4/2001 | Derstine | H01R 13/501 439/31 |
| 6,786,734 | B2 * | 9/2004 | Yu | H01R 35/02 439/11 |
| 7,121,852 | B2 * | 10/2006 | Ng | H01R 35/04 439/131 |
| D531,579 | S * | 11/2006 | Peng | D13/147 |
| 7,744,423 | B2 * | 6/2010 | Funahashi | H01R 31/065 439/638 |

(Continued)

OTHER PUBLICATIONS

"IEEE Standard for a Convergent Digital Home Network for Heterogeneous Technologies," IEEE Communications Society, IEEE Std 1905.1-2013, Apr. 12, 2013, 93 pages.

*Primary Examiner* — Chandrika Prasad

(74) *Attorney, Agent, or Firm* — Slater Matsil, LLP

(57) ABSTRACT

Embodiments of the present disclosure include an apparatus and a method for connecting a first device and second device. An apparatus includes an angled connector configured to connect to a first device to a second device, the first device and the second device configured to communicate through signal paths in the connector, the signal paths configured to pass digital data signals, a fastening device configured to secure the angled connector to the first device.

18 Claims, 3 Drawing Sheets

(56) References Cited

U.S. PATENT DOCUMENTS

| | | | | |
|---|---|---|---|---|
| D629,805 | S * | 12/2010 | Nysen | D13/147 |
| 7,918,673 | B1 * | 4/2011 | Mimura | H01R 13/6471 439/101 |
| 8,506,324 | B2 * | 8/2013 | Naufel | H01R 12/7082 439/541.5 |
| 8,657,628 | B2 * | 2/2014 | Xie | H01R 13/6583 439/607.1 |
| 8,702,441 | B2 * | 4/2014 | Farahani | G06F 1/1656 439/345 |
| 8,737,064 | B2 * | 5/2014 | Son | F16M 11/10 361/679.55 |
| 2006/0134962 | A1 * | 6/2006 | Yeh | H01R 13/6271 439/352 |
| 2006/0148310 | A1 * | 7/2006 | Funahashi | H01R 31/065 439/502 |
| 2010/0015838 | A1 * | 1/2010 | Blanton | H01R 13/6215 439/359 |
| 2011/0104950 | A1 * | 5/2011 | Sung | G06F 1/1632 439/620.22 |
| 2012/0034811 | A1 | 2/2012 | Ferderer | |
| 2013/0077234 | A1 * | 3/2013 | Farahani | G06F 1/1656 361/679.55 |

* cited by examiner

ANGLED CONNECTOR FOR CONNECTING TWO DEVICES AND HAVING A FASTENING DEVICE

PRIORITY CLAIM AND CROSS-REFERENCE

This application claims the benefit of the following provisionally filed U.S. Patent application: application Ser. No. 61/889,964, filed Oct. 11, 2013, and entitled "Method and Apparatus for Improving Connector Security and Device Coexistance," which application is hereby incorporated by reference.

TECHNICAL FIELD

This invention relates generally to connecting devices, and more particularly to a method and apparatus for the coexistence of a second device plugged in to a connector on the first device and the physical security of the first and second devices.

BACKGROUND

Electronic systems to day often contain many types of internal electronics. For example, a first device may contain one or more radio and wireless communications systems which work simultaneously, such as specified by IEEE 1905.1™-2013 "Standard for a Convergent Digital Home Network for Heterogeneous Technologies." The device may contain microprocessors which operate high clock rates and other high frequency circuits, for example, universal serial bus (USB) is a common communications technology that is currently capable of 4 Gbit/s and Gigabit Ethernet communication rate is capable of exceeding 1,000 Mbps, both of which are capable of high frequency signals and the noise they might create or propagate. The transistors and amplifiers in these systems typically support signal transitions of more than ten times the signaling rate, which is often ten times the clock rate or faster. This means that high frequency signals can be present in the circuits and interfaces for devices. Higher frequency noise can even be created as digital circuits switch through nonlinear transitions.

In some cases these high frequency signals and noise can interfere with a second device plugged into the first device or the second device may affect the first device. Thus, a solution is needed that can mitigate the potential for radiation from the devices.

SUMMARY OF THE INVENTION

An apparatus includes an angled connector configured to connect to a first device to a second device, the first device and the second device configured to communicate through signal paths in the connector, the signal paths configured to pass digital data signals, a fastening device configured to secure the angled connector to the first device.

Another embodiment is an apparatus including an angled connector configured to connect to a first device to a second device, the first device and the second device configured to communicate through signal paths in the connector, the angled connector having a length to provide radio frequency isolation between the first and second devices, and a fastening device configured to secure the angled connector to the first device.

A further embodiment is a method for connecting a first device and second device, the method including connecting a first end of an angled connector to a first device, fastening the angled connector to the first device using a first fastening device, and connecting a second device to a second end of the angled connector, the angled connector configured to provide signal paths between the first and second devices, the angled connector having a length to provide radio frequency isolation between the first and second devices.

The details of one or more embodiments of the invention are set forth in the accompanying drawings and the description below. Other features, objects, and advantages of the invention will be apparent from the description and drawings, and from the claims.

BRIEF DESCRIPTION OF THE DRAWINGS

For a more complete understanding of the present disclosure, and the advantages thereof, reference is now made to the following descriptions taken in conjunction with the accompanying drawings, in which.

Corresponding numerals and symbols in different figures generally refer to corresponding parts unless otherwise indicated. The figures are drawn to clearly illustrate the relevant aspects of embodiments of the present invention and are not necessarily drawn to scale. To more clearly illustrate certain embodiments, a letter indicating variations of the same structure, material, or process step may follow a figure number.

DETAILED DESCRIPTION OF ILLUSTRATIVE EMBODIMENTS

The making and using of embodiments are discussed in detail below. It should be appreciated, however, that the present invention provides many applicable inventive concepts that may be embodied in a wide variety of specific contexts. The specific embodiments discussed are merely illustrative of specific ways to make and use the invention, and do not limit the scope of the invention.

The present disclosure will be described with respect to embodiments in a specific context, namely a method and apparatus for improving connector security and device coexistence. Embodiments of this invention may also be applied to other circuits and systems, such as, but not limited to, wireless systems such as wireless communication systems.

Figure 1:
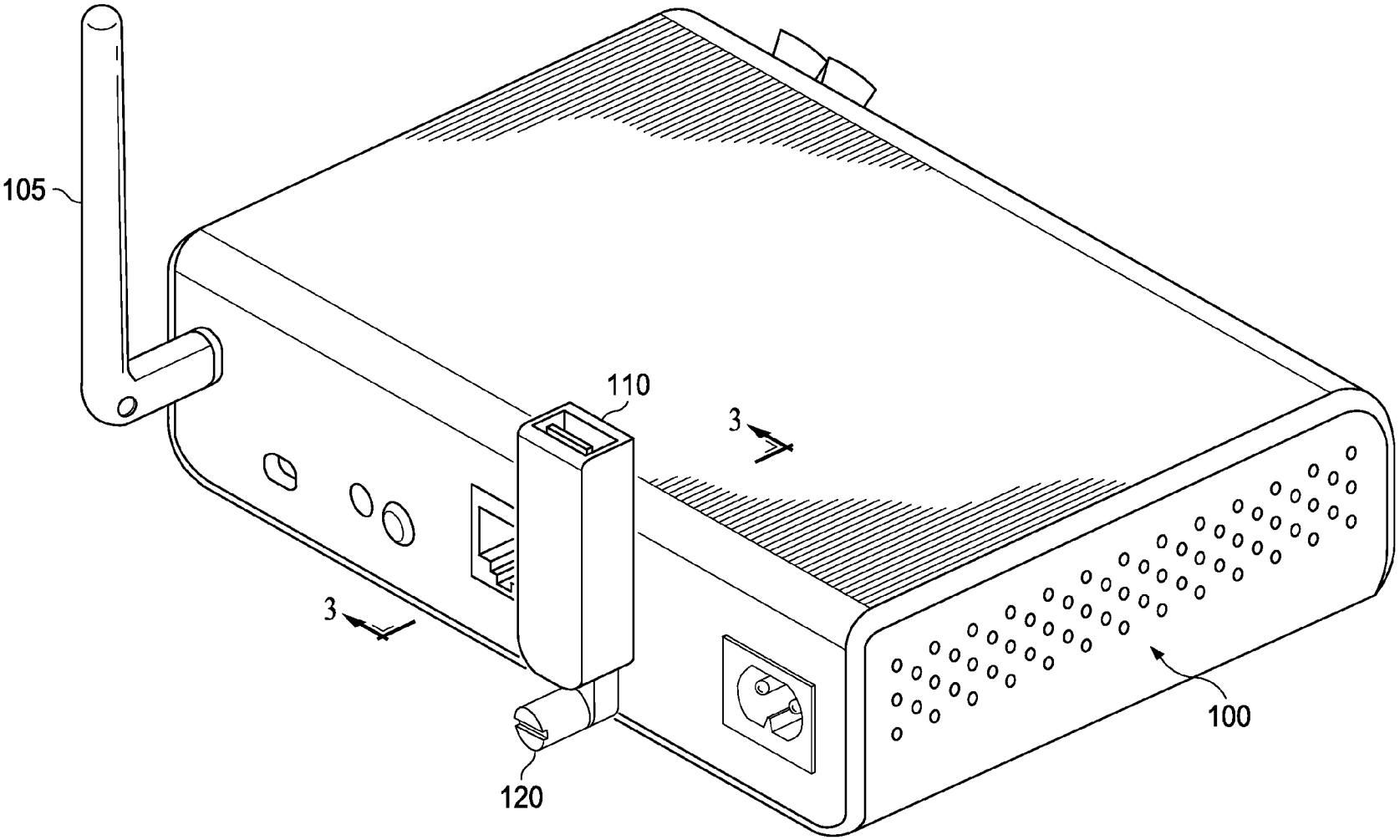
FIG. 1 illustrates an apparatus including a connector plugged into a device in accordance with an embodiment.
Figure 2:
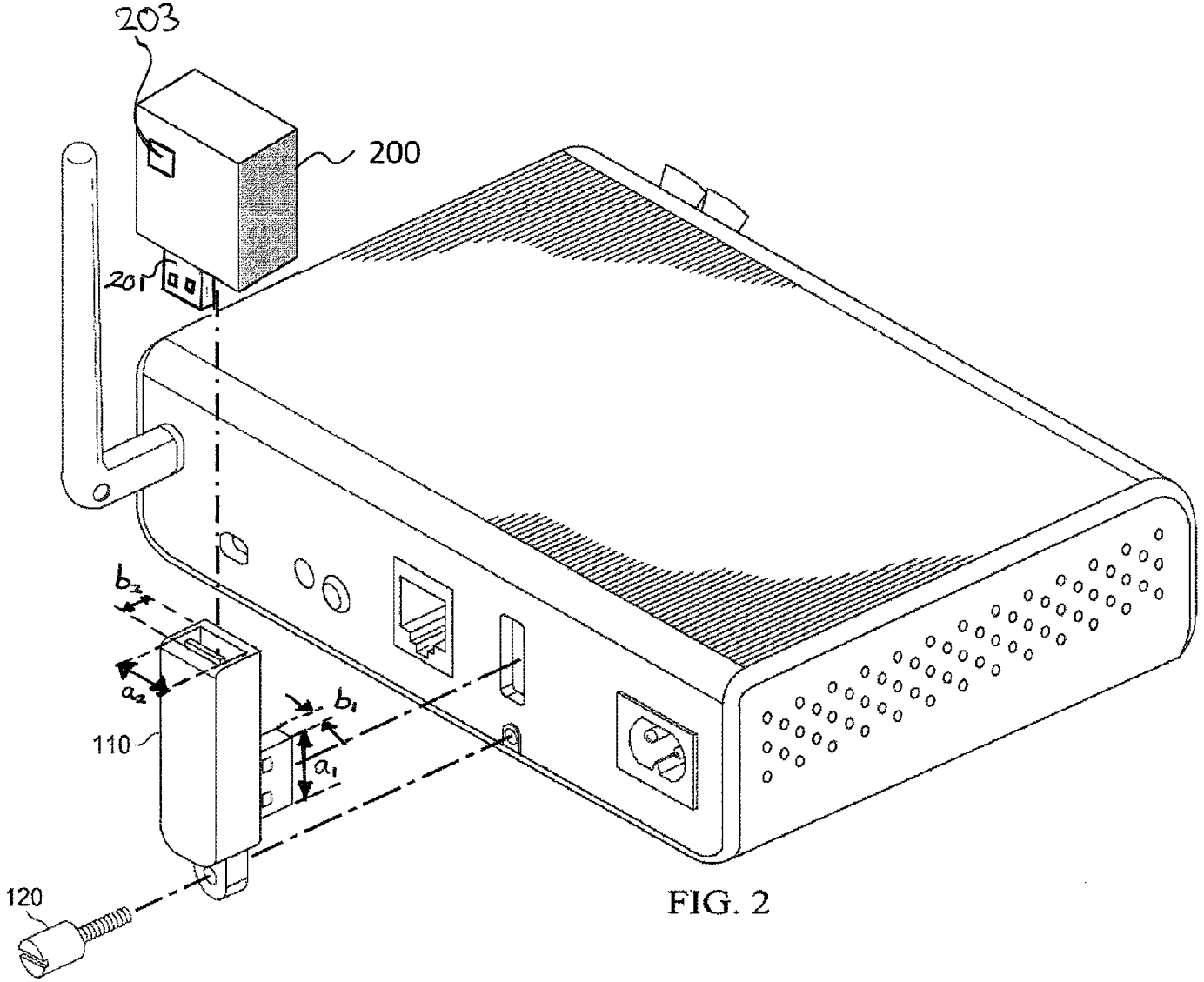
FIG. 2 illustrates the apparatus including the connector removed from the device in accordance with an embodiment.

FIG. 1 illustrates a first end of an angled connector no is plugged into a first device 100 in accordance with an embodiment. The angled connector no may be used to provide connectivity and support to a second device 200 (not shown in FIG. 1 but see FIG. 2) that is plugged to a second end of the angled connector 110. FIG. 2 illustrates the first end of an angled connector 110 is unplugged form the first device 100 in accordance with an embodiment. In an embodiment, the angled connector no is "L-shaped" and/or substantially forms a right angle (i.e. a 90° angle). The first device 100 may include an antenna 105 to transmit and receive Radio Frequency (RF) signals.

In some embodiments, the function of the second device 200 is as a radio transceiver composed of at least a radio and an antenna 203 and a USB port 201 (e.g., a standard female USB connector). The function of an antenna is to match the radio transmit and receive interface impedance to the 377 ohm free space impedance which allows the RF signal to effectively propagate. Successful propagation could interfere with susceptible circuits in the first device 100 or be received by other antennae. At close ranges, the second device's 200 radio frequency does not have to be the same as the frequencies used by the other radios to interfere with the first device 100. It may be close enough such that spurious or noise energy could affect the first device's 100 receiver's amplifiers and/or detectors. Physical separation, orthogonal orientation of the electromagnetic fields, and directional antenna design may help to prevent the devices from interfering with each other. At high frequencies, distances of inches are enough to prevent coexistence or co-location issues.

In some embodiments, it is also important that the angled connector no be a strong and stable connector. This is important because the second device 200 may be suspended at a distance away from the first device 100, and thus, the angled connector no may effectively become a lever for the second device 200 to apply a torque to the first device 100 and specifically the first device's connector 135 (see FIG. 3).

In some embodiments, shielding the noise at the source (the first device 100 and/or the second device 200) may be effective to allow the devices to coexist without either of the devices affecting the performance of the other device. However, in some embodiments, for example, connectors that are located on the edge of a printed circuit board (PCB) or where the interfaces carry high frequency signals, more protection than shielding may be needed.

In addition, when a first device 100 contains one or more radios or radio technologies such as Wi-Fi (IEEE 802.11 technology), Bluetooth technology, Zigbee (IEEE 802.15.4) technology, adding additional radios may cause interference. If it becomes necessary to add an additional radio device (receiver, transmitter or transceiver) the shield of the first device 100 may not be sufficient, at small distances, to isolate the second device 200 from noise or intentional transmissions.

Figure 3:
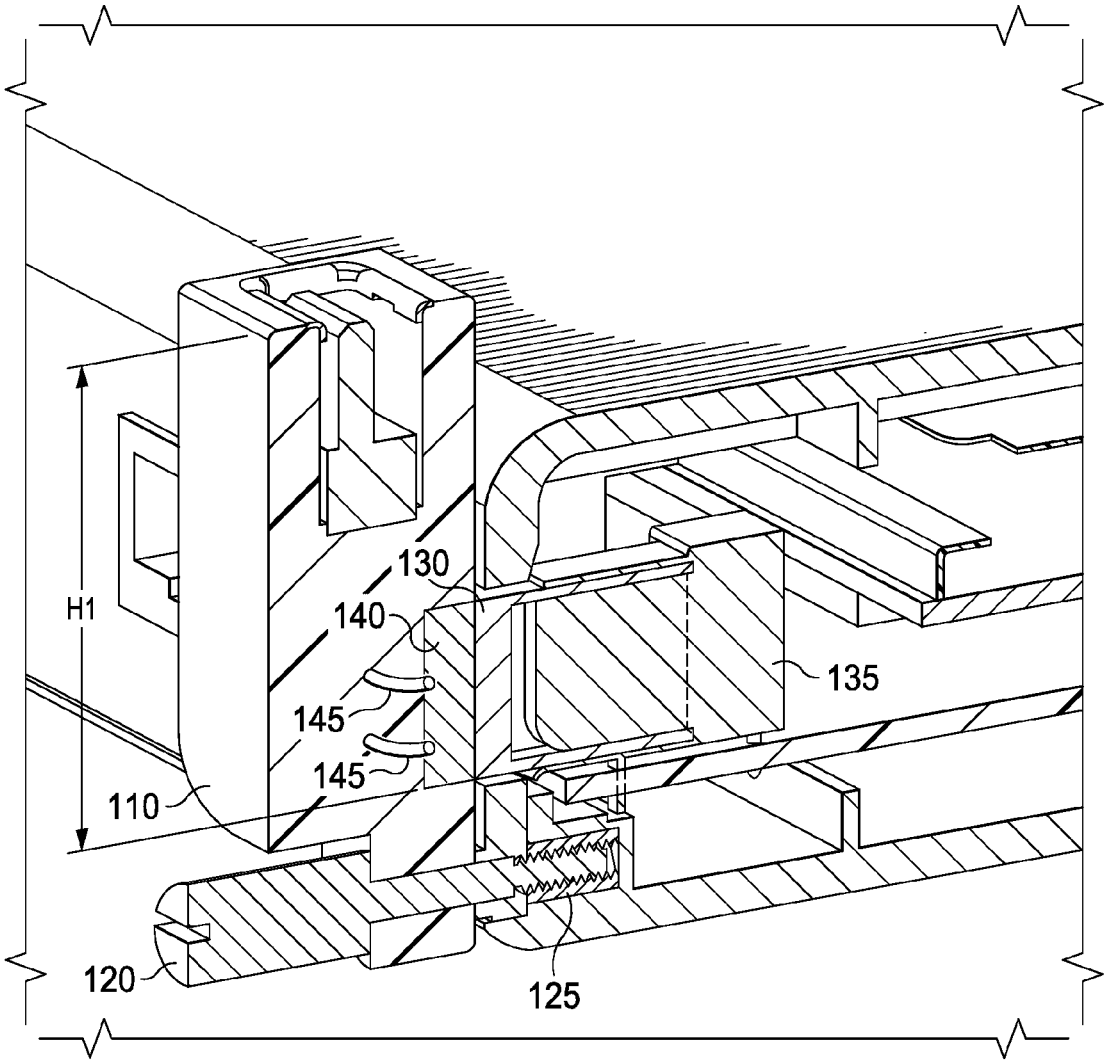
FIG. 3 illustrates a cross-sectional view of the apparatus including the connector plugged into the device in FIG. 1 in accordance with an embodiment.

FIG. 3 illustrates a cross-sectional view of an apparatus including the angled connector no plugged into the first device 100 in accordance with an embodiment. Signals from the first device 100 are presented to the signal conductors in the first device's connector(s) 135. In an embodiment, the conductors 130 of the angled connector 100 include at least one differential pair of wires 145 configured to pass digital data signals between the first device 100 and the second device 200. The conductors 130 connect to the receiving pins 140 located in the angled connector 110.

In an embodiment, the dominant radiation aperture of the first device's connector 135 is the diagonal dimension of the connector 135 in the first device 100. In some embodiments, this dominant radiation aperture is inside the shielding of the connector 135 inside the first device 100. That dimension is continued inside the angled connector 110, but, in some embodiments, is reduced as much as possible in height and width. The signal conductors 130 pass through the angled connector no in a way that makes the largest effective aperture of the signal conductors 130 orthogonal to that of the first device's 100 aperture. This configuration of the signal conductors 130 reduces the interference between the first device 100 and the second device 200. As shown in FIG. 2, the angled connector no has a first end including a standard male USB connector having a first front opening. The first front opening has a first dimension a1 along a first longitudinal axis and a second dimension b1 along a first transverse axis perpendicular to the first longitudinal axis. The second dimension b1 of the first front opening is smaller than the first dimension a1 of the first front opening. Furthermore, the angled connector no has a second end including a standard female USB connector having a second front opening. The second front opening has a first dimension a2 along a second longitudinal axis and a second dimension b2 along a second transverse axis perpendicular to the second longitudinal axis. The second dimension b2 of the second front opening is smaller than the first dimension a2 of the second front opening. As depicted in FIG. 2, the second longitudinal axis (along which first dimension a2 of the second front opening is measured) is perpendicular to the first longitudinal axis (along which first dimension a1 of the first front opening is measured), and the second longitudinal axis (along which first dimension a2 of the second front opening is measured) is parallel to the first transverse axis (along which second dimension b2 of the first front opening is measured).

The effective aperture size of a USB port, for example, is about 16.5 mm, which is one wavelength of about 18.2 GHz. The quarter wavelength radiating element for this frequency is about 4.55 GHz. A common rule of thumb for radio emissions from an aperture is that significant energy can be radiated down to 1/20th of the wavelength, or, in this example, down to about 910 MHz. Hence, the signals found in the first device 100 may have frequencies in the range that may propagate through the opening of the connector 135. The propagation may be in either direction, from the first device 100 to the second device 200 or from the second device 200 to the first device 100. If more interfaces are available, multiple radiation paths are possible. In some cases these signals can interfere with the second device 200 plugged into the angled connector no or the second device 200 may affect the first device 100.

In some embodiments, the new technology of the present disclosure could be added within the first device's 100 case/shield and the antenna 105 could be located externally to separate the antenna(s) 105 from the noise or co-location issues. In some embodiments, it is not possible to integrate the second devices 200 radio into the first device 100 case using a transmission line such as a coaxial line for physical separation due to regulations that restrict access to some connectors, such as those in the Industrial, Scientific, and Medical (ISM) radio bands. Moreover, adding radios within the first device's 100 case may require significant product redesign and/or regulatory approvals.

Hence, the angled connector no provides the flexibility to physically separate the first and second devices and to change their orientation, thereby addressing the means to mitigate interference, and improve mutual coexistence. The height (height H1 in FIG. 3) of the angled connector no is made long enough to physically isolate the second device 200 which is plugged into its top, from the first device 100. At high frequencies that are used in today's components, distances of less than two inches can resolve interference issues. The angled connector no may also be oriented to minimize exposure to RF noise or interaction with the antenna 105.

In order to secure the devices with respect to each other, a fastening device 120 firmly attaches the angled connector no to the first device 100. In an embodiment, the fastening device 120 is a screw, a holding clip, a pin, a clamping device, a hook, the like, or any other suitable fastening device. The fastening device 120 may be located anywhere that does not affect the signal or shielding integrity. The fastening device 120 also allows the second device 200 to be secured to it. For example, the fastening device 120 may be internally or externally tapped to accept another screw from the second device 200. This arrangement not only address the devices mutual security but can also lock in the physical relationship between (orientation) the devices which is important to coexistence as previously presented.

In an embodiment, the connector is USB and its signals are conducted coaxially through the angled connector 110 so that the signal is as shielded as much as possible from a coverage perspective but still within the capacitance specification for the connector. In an embodiment, the standard USB connector as shown in FIGS. 2 and 3 is preferred because of its physical robustness. In another embodiment, a micro-USB connector, a mini-USB connector, the like, or a combination thereof may be used to reduce the overall physical space required.

In another embodiment, the signals are additionally conducted in coaxial cables (see, e.g., 145 in FIG. 3).

In another embodiment, the connector is not limited to vertical or horizontal male or female connections but a vertical connection is shown as the exemplary orientation. In an embodiment, the orientation of the connector is vertical to allow the connector to better support the weight of the second device 200.

In another embodiment, the fastening screw is fitted with additional internal or external threads so that the second device 200 may be secured to it.

It will also be readily understood by those skilled in the art that materials and methods may be varied while remaining within the scope of the present invention. It is also appreciated that the present invention provides many applicable inventive concepts other than the specific contexts used to illustrate embodiments. Accordingly, the appended claims are intended to include within their scope such processes, machines, manufacture, compositions of matter, means, methods, or steps.

What is claimed is:

1. An apparatus comprising:

an angled connector comprising a first end configured to connect to a first device and a second end configured to connect to a second device, the first device and the second device configured to communicate through signal paths in the angled connector, the signal paths configured to pass digital data signals, the first end comprising a standard male Universal Serial Bus (USB) connector, the standard male USB connector of the first end of the angled connector having a first front opening, the first front opening being rectangular, the first front opening having a first dimension along a first longitudinal axis and a second dimension along a first transverse axis perpendicular to the first longitudinal axis, the second dimension of the first front opening being smaller than the first dimension of the first front opening, the second end comprising a standard female USB connector, the second end having a surface spaced from a parallel surface of the first end by a first height, the standard female USB connector of the second end of the angled connector having a second front opening, the second front opening being rectangular, the second front opening having a first dimension along a second longitudinal axis and a second dimension along a second transverse axis perpendicular to the second longitudinal axis, the second dimension of the second front opening being smaller than the first dimension of the second front opening, the second longitudinal axis being perpendicular to the first longitudinal axis, and the second longitudinal axis being parallel to the first transverse axis; and a fastening device configured to secure the angled connector to the first device.

2. The apparatus of claim 1, wherein the angled connector substantially forms a right angle.

3. The apparatus of claim 1, wherein the signal paths comprise conductive wires.

4. The apparatus of claim 1, wherein the signal paths comprise coaxial conductive wires.

5. The apparatus of claim 1, wherein the fastening device comprises a screw, a holding clip, a pin, a clamping device, a hook, or a combination thereof.

6. The apparatus of claim 1, wherein the standard female USB connector of the second end of the angled connector is configured to directly connect to the second device, wherein the second device is outside an outer case of the first device when the second device is directly connected to the standard female USB connector of the second end of the angled connector.

7. The apparatus of claim 1, wherein the fastening device comprises a screw, the screw extending through a portion of the angled connector and extending into the first device.

8. The apparatus of claim 1, wherein the first height is two inches or less.

9. An apparatus comprising:

a first device comprising a first antenna and a first connection port, the first device configured to transmit and receive radio frequency signals using the first antenna, the first connection port being a first standard female Universal Serial Bus (USB) port;

an angled connector having a first portion connected to the first connection port of the first device, the first portion having a first standard male USB port inserted into the first standard female USB port of the first device, the first portion extending in a first direction, the angled connector further comprising a second portion extending a first distance in a second direction, the second direction being different from the first direction, the second portion having a second standard female USB port;

a second device comprising a second antenna and a second standard male USB port, the second device configured to transmit and received radio frequency signals using the second antenna, the second standard male USB port of the second device inserted into a second standard female USB port of the angled connector, the first device and the second device configured to communicate through signal paths in the angled connector; and a fastening device securing the angled connector to the first device, wherein the first device has a major top surface and a first sidewall perpendicular to the major top surface, the first standard male USB port of the angled connector having a first front opening, the first front opening being rectangular, the first front opening having a first longitudinal axis, the first longitudinal axis being perpendicular to the major top surface of the first device, the second standard female USB port of the angled connector having a second front opening, the second front opening being rectangular, the second front opening having a second longitudinal axis, the second longitudinal axis being parallel to the major top surface of the first device.

10. The apparatus of claim 9, wherein the first direction and the second direction substantially forms a right angle.

11. The apparatus of claim 9, wherein the angled connector is a Universal Serial Bus (USB) connector.

12. The apparatus of claim 9, wherein the signal paths comprise coaxial conductive wires.

13. The apparatus of claim 9, wherein the fastening device comprises a screw, a holding clip, a pin, a clamping device, a hook, or a combination thereof.

14. An apparatus comprising:

a connector configured to connect a first device to a second device, the first device and the second device configured to communicate through signal paths in the connector, the signal paths configured to pass digital data signals, the connector having a first portion and a second portion with the first portion being at a right angle relative to the second portion, the first portion extending in a first direction, the second portion extending a first distance in a second direction, the right angle relationship of the first portion and the second portion being permanently affixed; and a fastening device configured to secure the connector to the first device, the fastening device comprising a screw, the screw extending through a portion of the connector and extending into the first device.

15. The apparatus of claim 14, wherein at least a portion of the first portion of the connector is configured to be inserted within the first device.

16. The apparatus of claim 14, wherein the first portion of the connector comprises a male Universal Serial Bus (USB) connector.

17. The apparatus of claim 14, wherein the second portion of the connector comprises a female Universal Serial Bus (USB) connector.

18. The apparatus of claim 14, wherein the signal paths comprise coaxial conductive wires.

* * * * *